US006230969B1

(12) United States Patent
Spransy

(10) Patent No.: US 6,230,969 B1
(45) Date of Patent: May 15, 2001

(54) FOOD CONTAINER AND SAUCE RESERVOIR ARRANGEMENT

(76) Inventor: Peter J. Spransy, 2753 S. Venar Cir., Salt Lake City, UT (US) 84109

( * ) Notice: Subject to any disclaimer, the term of this patent is extended or adjusted under 35 U.S.C. 154(b) by 0 days.

(21) Appl. No.: 09/524,838

(22) Filed: Mar. 14, 2000

Related U.S. Application Data

(60) Provisional application No. 60/124,791, filed on Mar. 17, 1999.

(51) Int. Cl.[7] ..... B65D 21/024

(52) U.S. Cl. ..... 229/400; 220/23.4; 220/23.83; 229/904; 229/906

(58) Field of Search ..... 229/400, 902, 229/904, 906; 220/23.4, 23.83, 23.86, 482, 528; D9/347

(56) References Cited

U.S. PATENT DOCUMENTS 3,442,435 * 5/1969 Ludder et al. ..... 220/528
4,854,466 * 8/1989 Lane, Jr. ..... 220/23.83
5,429,262 * 7/1995 Sharkey ..... 220/23.4
5,540,333 * 7/1996 Gonzalez et al. ..... 229/400
5,630,544 * 5/1997 Shane ..... 229/906
5,799,794 * 9/1998 Whitnell ..... 229/904
5,842,631 * 12/1998 Berger ..... 229/904
6,062,468 * 5/2000 Tausanovitch ..... 229/400
6,076,700 * 6/2000 Manges ..... 220/23.4

* cited by examiner

*Primary Examiner*—Gary E. Elkins
(74) *Attorney, Agent, or Firm*—TraskBritt

(57) ABSTRACT

A food container having a sauce container coupled thereto is disclosed. The food container includes an open top adapted for received food articles. The sauce container also includes an open top. Coupling structure suited for yielding either a detachable or permanent coupling of the two containers is mechanically associated with the two containers.

6 Claims, 11 Drawing Sheets

FOOD CONTAINER AND SAUCE RESERVOIR ARRANGEMENT

CROSS REFERENCE TO RELATED APPLICATION

This application claims the benefit of the filing date of U.S. Provisional Patent Application Ser. No. 60/124,791, filed Mar. 17, 1999.

BACKGROUND OF THE INVENTION

1. Field of the Invention

The present invention relates to condiment reservoirs and food containers typically used in the "fast-food" industry. More particularly, the invention is directed to food containers and condiment reservoirs for containing a variety of condiments including sauces which are compatible with the food held in the companion food container, such as catsup for French fries, sweet and sour sauce for chicken nuggets, etc.

2. State of the Art

The quick-service (also known as "fast-food") restaurant industry is intensely competitive. This competition is primarily through quality, variety, and value perception of food products offered. In addition, location, speed of service, and effective marketing of new products are included among other important factors that yield a competitive advantage. Further, it is universally accepted in the industry that menu variety is an important part of customer satisfaction and that competitive advantage can also be established through a unique and diverse menu including a wide choice of condiments/sauces.

High sales are achieved in this highly competitive arena by providing quality products at everyday values. Earnings, on the other hand, are derived through careful control of food costs, labor costs, and other operating costs. Therefore, while "fast-food" restaurants constantly research new ways to gain market share, the most valuable changes are those that are made through low additional costs.

"Fast-food" restaurants were created to meet the demands of a mobile society. A principle requirement of the "fast-food" consumer is the ease in eating "fast-food" products while engaged in another activity, such as driving a car, walking, standing-waiting for a bus, etc. This is illustrated in part by the concept of the "drive up window" wherein consumers can purchase food and then actually eat while driving as they continue running errands. Presently, "fast-food" restaurants provide small packages and cups of catsup and other sauces (e.g., sweet and sour, honey mustard, etc.) that can be combined with "fast-food" products (e.g., French fries, chicken nuggets, buffalo wings, etc.). One method of combining sauce to food products is to squeeze out the sauce from said package onto a surplus food wrapper where the consumer can then begin to dip their food into the sauce. Another method is to squeeze the sauce from said package directly onto the food, a third method is to dip the food into a small cup of sauce. At the very least these options are inconvenient, in some cases not terribly appetizing and often messy. If one is not at a table, driving in one's car for instance, using the sauce on a surplus wrapper is not practical. The method of applying the sauce directly onto the food is very messy and using a cup of sauce is very awkward. As described above, most "fast-food" restaurants have drive-up windows where consumers are invited to speedily purchase a meal and eat on the run. Sometimes consumers will simply stop and eat in their car, others might stop and sit on a park bench while still others will continue on their way and must negotiate the inconvenience of eating while driving. In each scenario attempting to eat food with sauce is very inconvenient often times causing the consumer to preclude the use of any sauce, thus diminishing the culinary experience of consuming the food product.

Referring to drawing FIG. 1, the McDonald's Corporation (among others) has introduced a cardboard French fries container 10 having an enlarged opening 12 for receiving French fries (not shown). A side structure 16 having a flat lower most portion 18 forming a stable base to permit the container to be freestanding when placed on a horizontal surface. The container further includes a curved rear structure 22 and a curved frontal structure 24, wherein both structures are convex to the enlarged opening 12. A bottom structure 26 having a curved shape 28 forms the curves of curved rear structure 22 and of curved frontal structure 24 when pressed up inside the container from outside to inside. Typically fries containers are stored flat until needed. When needed, the bottom structure 26 is pressed (snapped) up into the underside of the fries container creating the enlarged opening 12 thus forming the shape of the curved rear structure 22 and the curved frontal structure 24.

The McDonald's Corporation (among others) has introduced a vacuum-formed sauce container 30 as shown in FIG. 2. This embodiment provides an upwardly projecting cup shape 32 defining a horizontally projecting plane 34 at the full perimeter of the upper most portion of the cup 32. The plane 34 is the by-product of the manufacturing method known as vacuum-forming and historically has been used only as a surface to adhere a mylar/foil seal 36 thereto to provide a hermetically sealed container for the preservation of the enclosed sauce (not shown). The seal 36 is used to maintain food safety and consumer's perception of same.

The Wendy's Corporation (among others) has introduced a folded paper sauce container 31 as shown in drawing FIG. 2A. The shape of the sauce container is generally a truncated cone, tapering to a smaller diameter in the downward direction. This container 31 provides an upwardly projecting cup shape 33 having a lip 35 around the entire perimeter of the upwardly projecting cup shape 33.

Referring to FIG. 3, the McDonald's Corporation (among others) has introduced a mylar/foil sauce package 38. The package 38 is a pillow shaped package of sauce having serrated edges 40 at two sides of said package 38. The serrations 40 are designed to simplify opening of the sauce package 38.

SUMMARY OF THE INVENTION

The present invention relates to a method and structure for coupling a condiment reservoir to a food container to improve the convenience of eating food from such a container with a condiment. The invention enables the condiment and food container to be easily held in one hand and reduces the mess associated with eating food from such a container with a condiment. The invention is especially beneficial to a user engaged in an activity such as driving a car, walking, standing-waiting a bus, etc. In one embodiment of the present invention, a food container is adapted with structure for attaching a condiment reservoir thereto. In a second embodiment, a condiment reservoir is adapted with structure adapted for attaching the condiment reservoir to a food container. In yet another embodiment, a coupling structure is mechanically associated with a condiment reservoir and a food container, the coupling structure being adapted for attaching the reservoir to the food container.

The present invention contemplates various structures for interconnecting a condiment reservoir and a food container, such structures may include adhesive strips, an integral carriage formed as part of the fries container, and mechanical structure formed in the condiment reservoir. The present invention also contemplates some embodiments wherein the attachment of the reservoir to the food container is a permanent attachment. In other embodiments, the attachment is a detachable or removable attachment. In some embodiments the food container and the condiment reservoir may form an integral structure, while in other embodiments the reservoir is a separate element distinct from the food container.

A condiment reservoir is an important aspect of the invention because it simplifies storage considerations and offers the flexibility of numerous condiment options to the consumer, provided that whatever the means of attachment, the attachment couples the condiment reservoir to the food container.

DETAILED DESCRIPTION OF THE INVENTION

The present invention will be better understood when the drawings are taken in conjunction with the detailed description of the invention.

Figure 1:
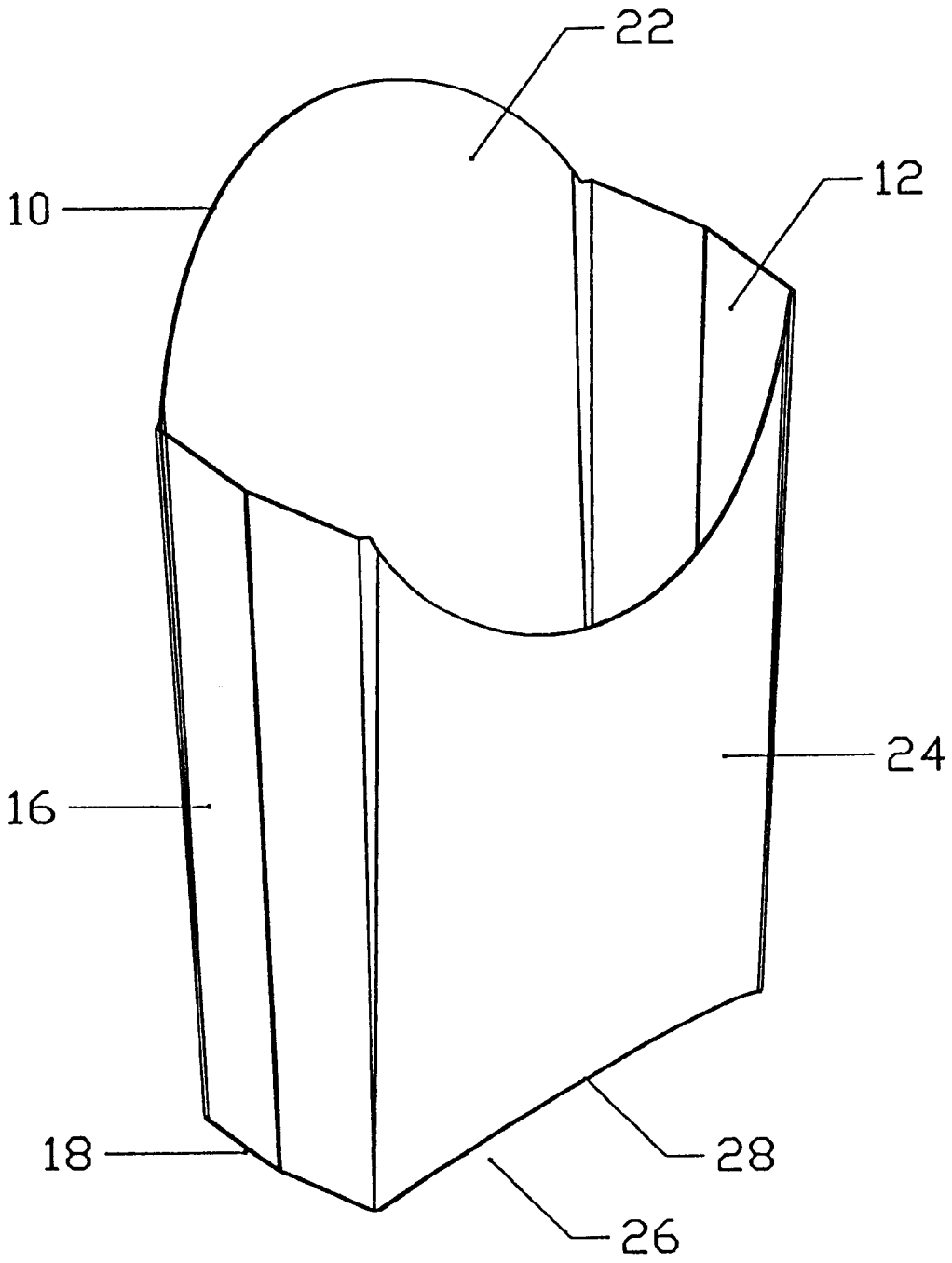
Fig. 1 (PRIOR ART)
FIG. 1 shows a perspective view of a prior art French fries container.

Drawing FIG. 1 illustrates a conventional cardboard French fries container 10 having an enlarged opening 12 for receiving French fries (not shown). Side structure 16 includes a flat lowermost portion 18 which forms a stable base to permit the container to be freestanding when placed on a horizontal surface. A curved rear structure 22 and a curved frontal structure 24, are positioned to be convex to the enlarged opening 12. A bottom structure 26 has a curved shape 28 that forms the curved configuration of curved rear structure 22 and of curved frontal structure 24 when pressed up inside the container from outside to inside. Typically the fries containers are stored flat until needed, at which time the bottom structure 26 is pressed (snapped) up into the underside of the fries container creating the enlarged opening 12 thus forming the shape of the curved rear structure 22 and the curved frontal structure 24.

Figure 2:
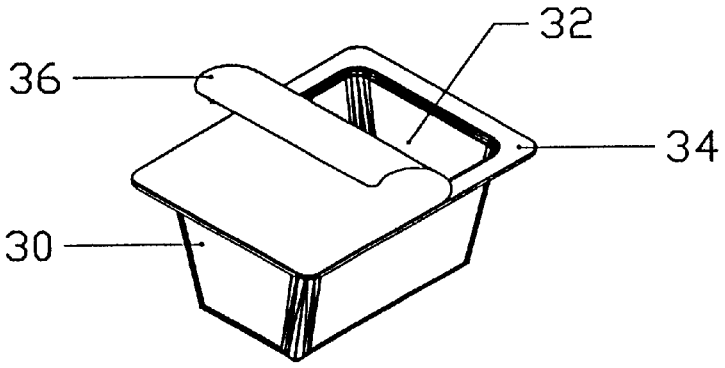
Fig. 2 (PRIOR ART)
FIG. 2 shows a perspective view of a prior art vacuum-formed sauce reservoir.

Referring to drawing FIG. 2, a conventional vacuum-formed sauce container 30 is shown. The container provides an upwardly projecting cup shape 32 and a horizontally projecting flange or plane 34 which extends about the full perimeter of the upper most portion of the cup 32. The flange 34 is the by-product of the manufacturing method known as vacuum-forming. Historically, the flange has been used only as a surface to adhere a mylar/foil seal 36 thereto to provide a hermetically sealed container for the preservation of the enclosed sauce (not shown). The seal 36 is used to maintain food safety and consumer's perception of same.

Figure 3:
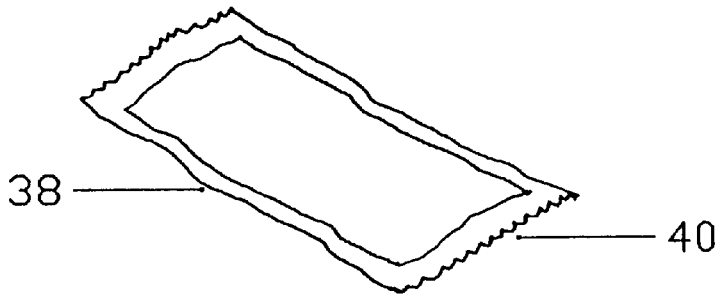
Fig. 3 (PRIOR ART)
FIG. 3 shows a perspective view of a prior art mylar/foil sauce package.
Figure 2A:
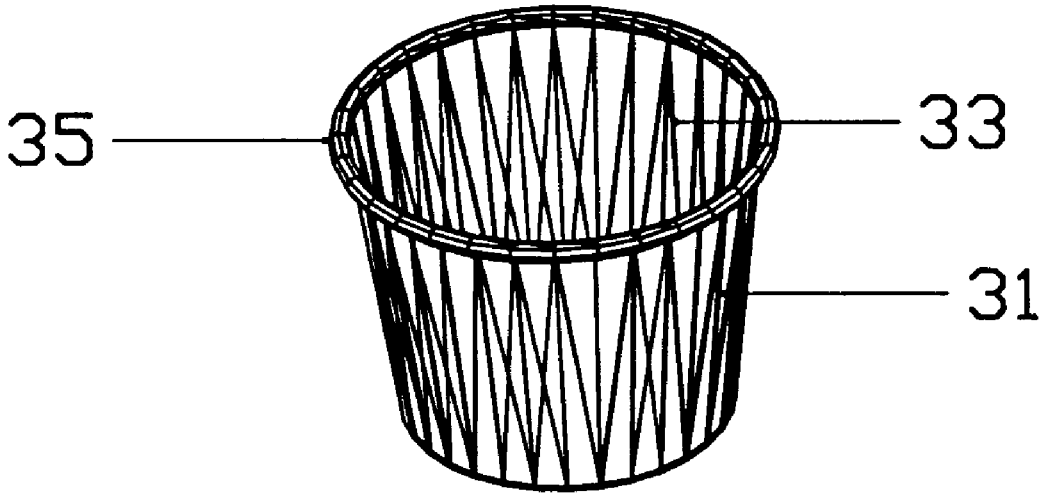
Fig. 2A (PRIOR ART)
FIG. 2A shows a perspective view of a prior art sauce container.

Drawing FIG. 3 illustrates a conventional mylar/foil sauce package 38, which is unaffected by present invention.

The present invention provides a structure for interconnecting a condiment reservoir with a food container, preferably in a spatially proximate orientation. Various structures for interconnecting the condiment reservoir to the food container are contemplated in the invention. The illustrated invention is presently described by means of a french fry container in association with a sauce container. It should be understood that the invention is not limited to this particular type of food container nor this particular type of condiment. Instead, the invention is seen as being applicable to a variety of food containers and their associated condiments.

Figure 4:
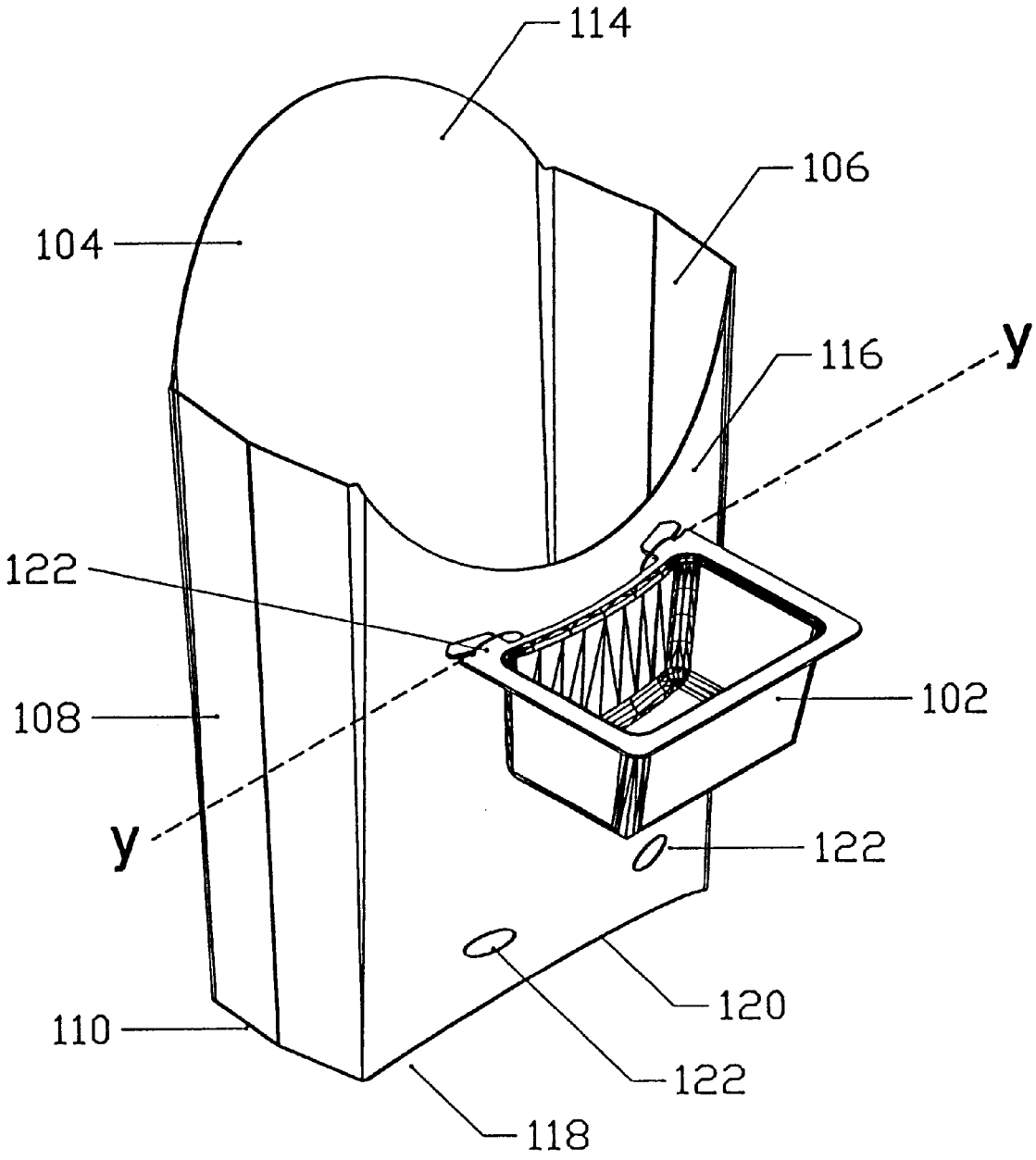
FIG. 4 shows a perspective view of a first embodiment of the present invention.

Referring to drawing FIG. 4, a first embodiment 100 of the invention is shown as having a catsup/sauce reservoir 102 coupled to a fries/food container 104. The fries container 104 includes an enlarged opening 106 for receiving French fries (not shown). A side structure 108 having a flat lowermost portion 110 which forms a stable base to permit the container to be freestanding when placed on a horizontal surface. The container 104 further includes a curved rear structure 114 and a curved frontal structure 116. Both of the front and rear structures are oriented to be structures convex to the enlarged opening 106. A bottom structure 118 having a curved shape 120 forms the curves of curved rear structure 114 and the curved frontal structure 116 when the bottom structure is pressed up inside the container from outside to inside. Typically the fries containers are stored flat until needed. When needed, the bottom structure 118 is pressed (snapped) up into the underside of the fries container creating the enlarged opening 106 thereby forming the shape of the curved rear structure 114 and the curved frontal structure 116.

Numerous systems for attaching the catsup/sauce reservoir 102 to the fries/food container 104 may be used. For the purpose of the present description, the preferred structure of attachment requires apertures 122 that provide predetermined locations for releasably attaching the reservoir 102 to the container 104. See FIG. 7. The apertures 122 may be in various positions on the fries container 104 to account for stability and center of gravity considerations. An advantage realized by utilizing the apertures 122 as a method of attachment is they do not interfere with the present practice of storing the French fries containers in a collapsed condition, i.e., flat, prior to their use.

Figure 7:
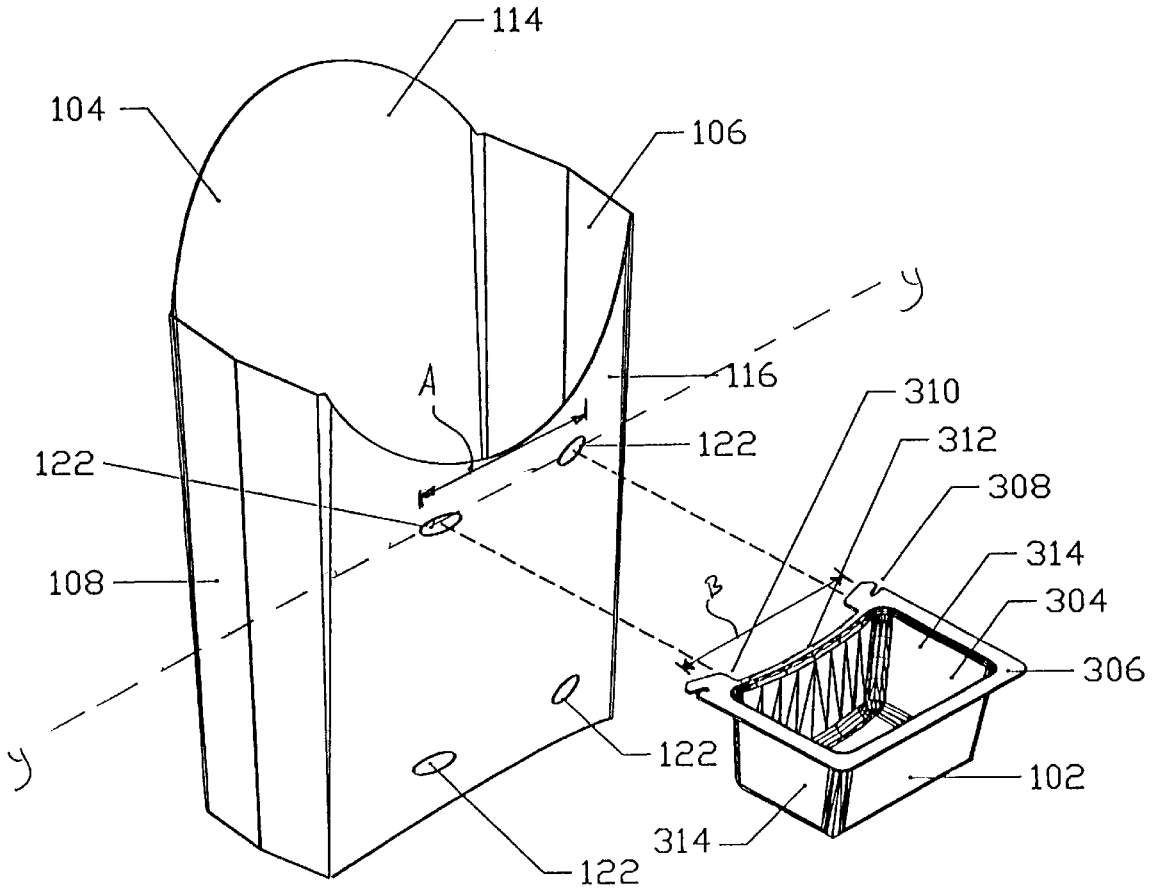
FIG. 7 shows an exploded view of the present invention.

Various locations of the apertures 122 are possible, for the purpose of the present invention, the preferred locations of the apertures 122 as shown in FIG. 7 are identified.

Figure 5:
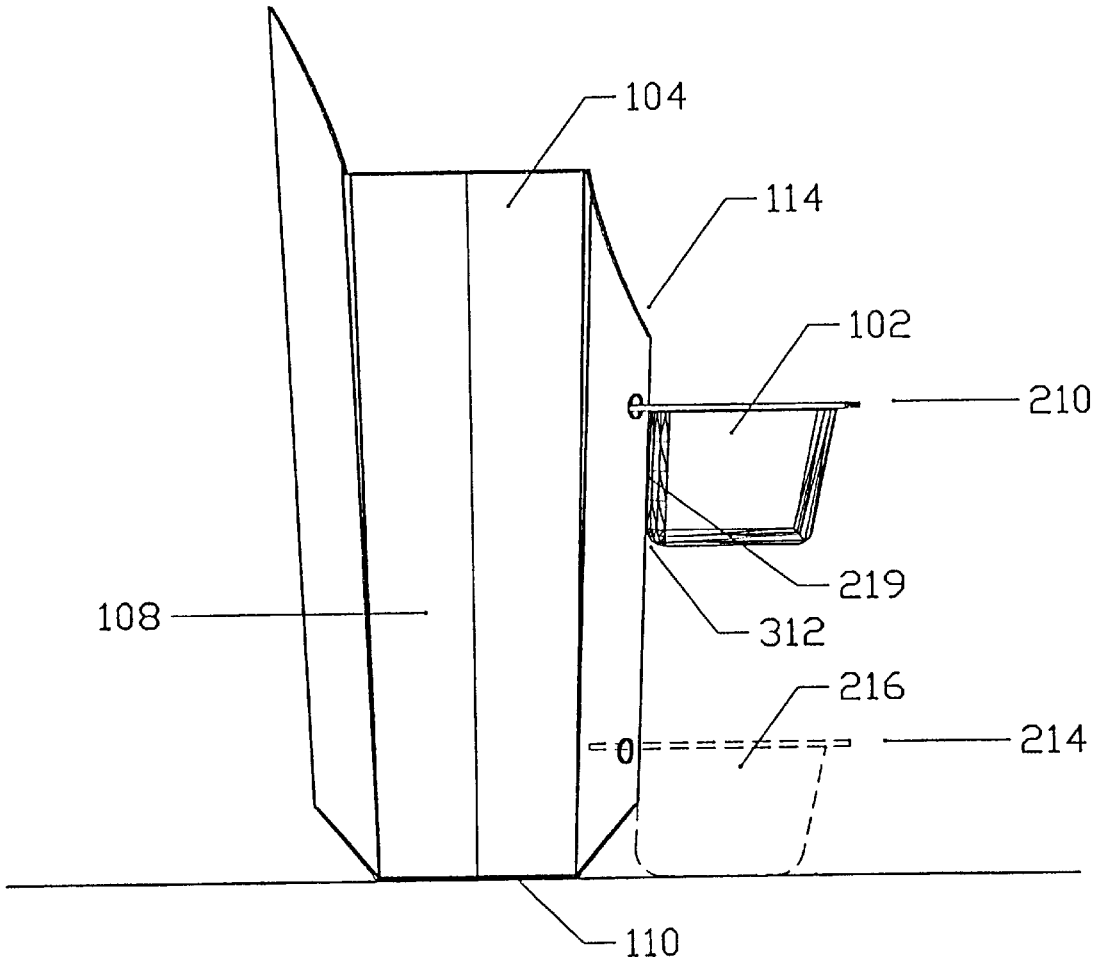
FIG. 5 shows a side view of the first embodiment of the present invention.

Referring to drawing FIG. 5, a sauce reservoir 102 is coupled at the uppermost position 210 of the fries container 104, this being one of the preferred locations of positioning the coupled sauce reservoir. The uppermost position 210 locates the sauce reservoir 102 in close proximity to the enlarged opening 114 of the fries container 104 and fries (not shown). An alternate location of the sauce reservoir 216 (dashed), i.e., at a lowermost position 214 is also illustrated. In the lowermost position of the sauce reservoir 102 (dashed), the lowermost portion of the sauce reservoir 216 is in the same horizontal plane as the lowermost portion 110 of the side structure 108. This orientation is the second preferred location of the coupled sauce reservoir, in that it facilitates the placement of the coupled fries container 104 and sauce reservoir 102 on a horizontal surface permitting it to be freestanding.

Figure 6:
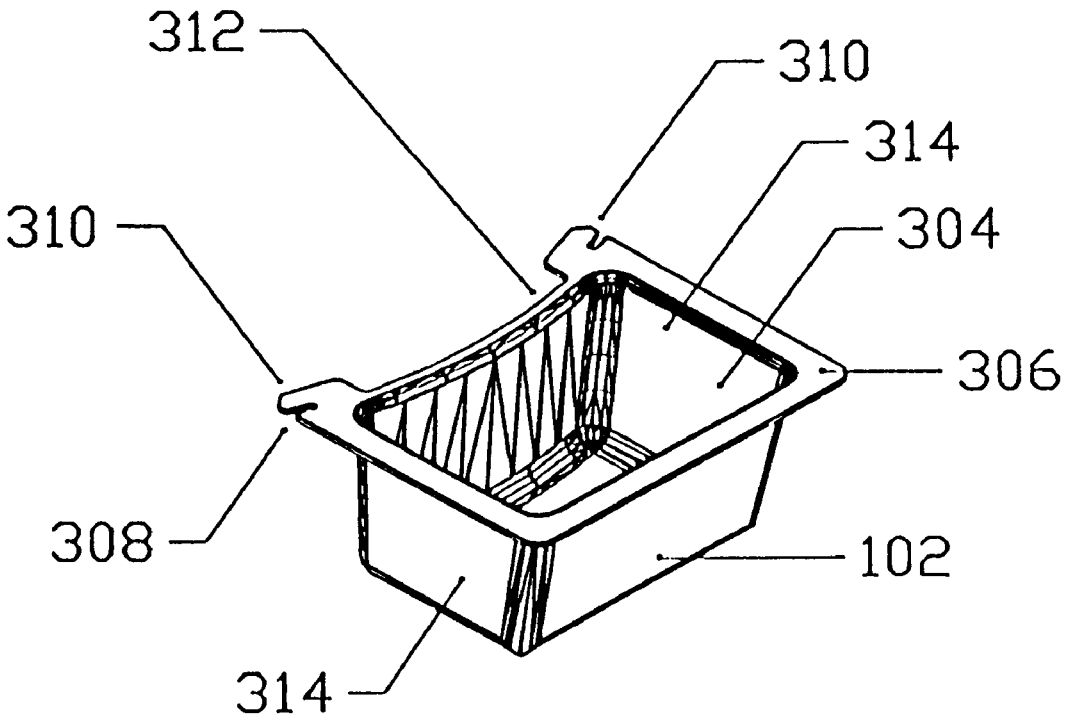
FIG. 6 shows a perspective view of a sauce container adapted for use in the present invention.

FIG. 6 illustrates a sauce reservoir 102 which has been configured for use in the present invention. The container 102 is shown having a vacuum-formed shape. The sauce container 102 provides an upwardly projecting cup shape 304 and a horizontally projecting flange or plane at the full perimeter of the uppermost portion of said cup 304. The flange 306 may be formed by vacuum-forming and may be used as a surface to adhere a mylar/foil seal (not shown) thereto to provide a hermetically sealed container for the preservation of the enclosed sauce (not shown). A system for attaching the catsup/sauce reservoir 102 to a fries/food container may be configured in the flange 306. As shown, a pair of clip-like ears 310 are formed on opposing sides of the flange 306. Various methods can be applied to form clip 310, in this embodiment. For example, the horizontal flange 306 may be die-cut thereby forming the clip 310. For this preferred method of attachment the sauce reservoir 102 would embody a curved rear wall 312 and opposing side walls 314. The reservoir flange 306 is preferably formed of a material which has some flexibility associated therewith, e.g., plastic. This elasticity permits the clips 310 to be urged toward each other and thereafter inserted into the apertures 122 of container 104. After the insertion of the clips the side walls of the reservoir are released thereby permitting them to spring back and into engagement against the sidewalls of the container 104 which defines the apertures 122.

Each of the clips 310 defines a notch 308 therein which is adapted to receive a portion of the sidewall of the container 104 and form a spring biased pressure fit union with that sidewall. The distance (A) separating the outermost edges of the two openings 122 is dimensioned to be slightly less than the distance (B) separating the innermost ends of the notches 308. The notch further provides a measure of resistance against a rotation of the container about axis y—y.

Referring to FIG. 5, the sauce reservoir 102 is preferably configured such that when it is placed in its coupled orientation the lower edge of the curved rear wall 312 abuts against and otherwise engages the surface of the front wall 214 of the container 104.

Figure 8:
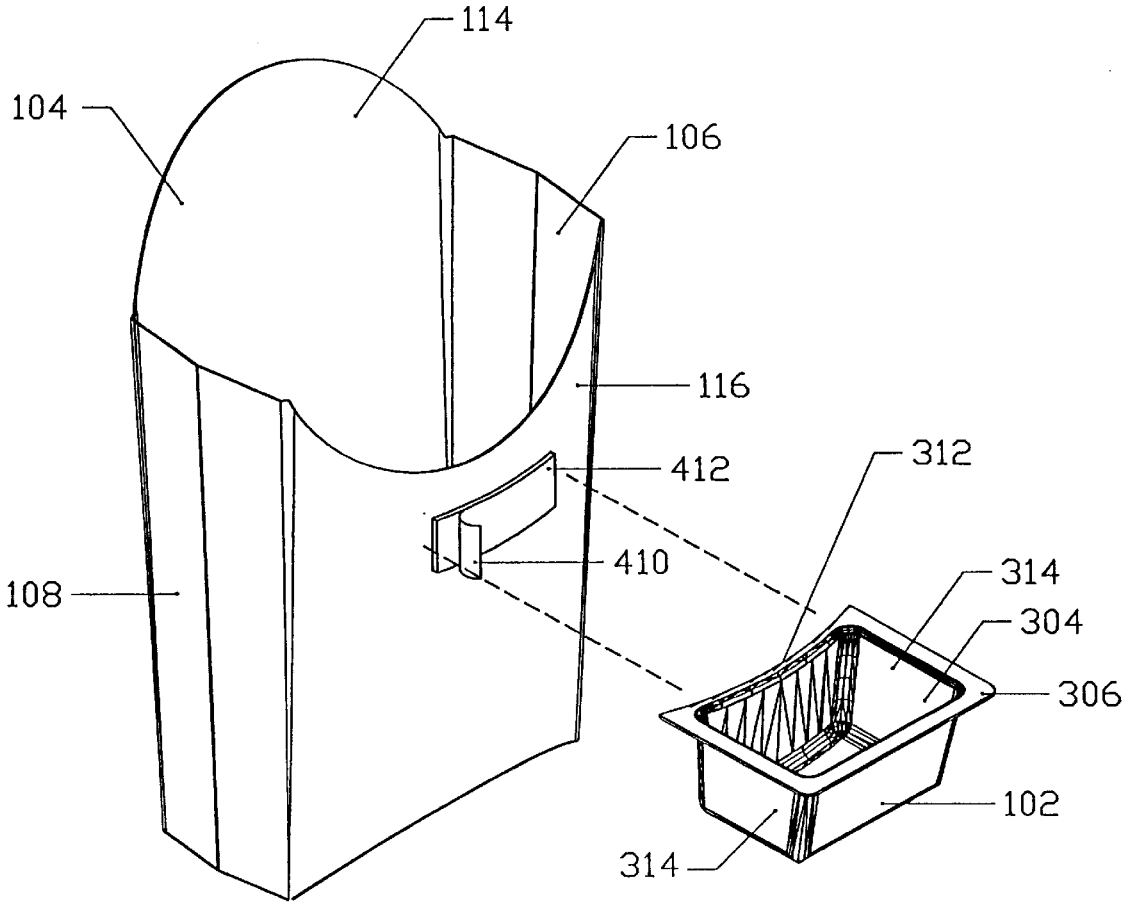
FIG. 8 is a perspective view of a second embodiment of the invention.
Figure 9:
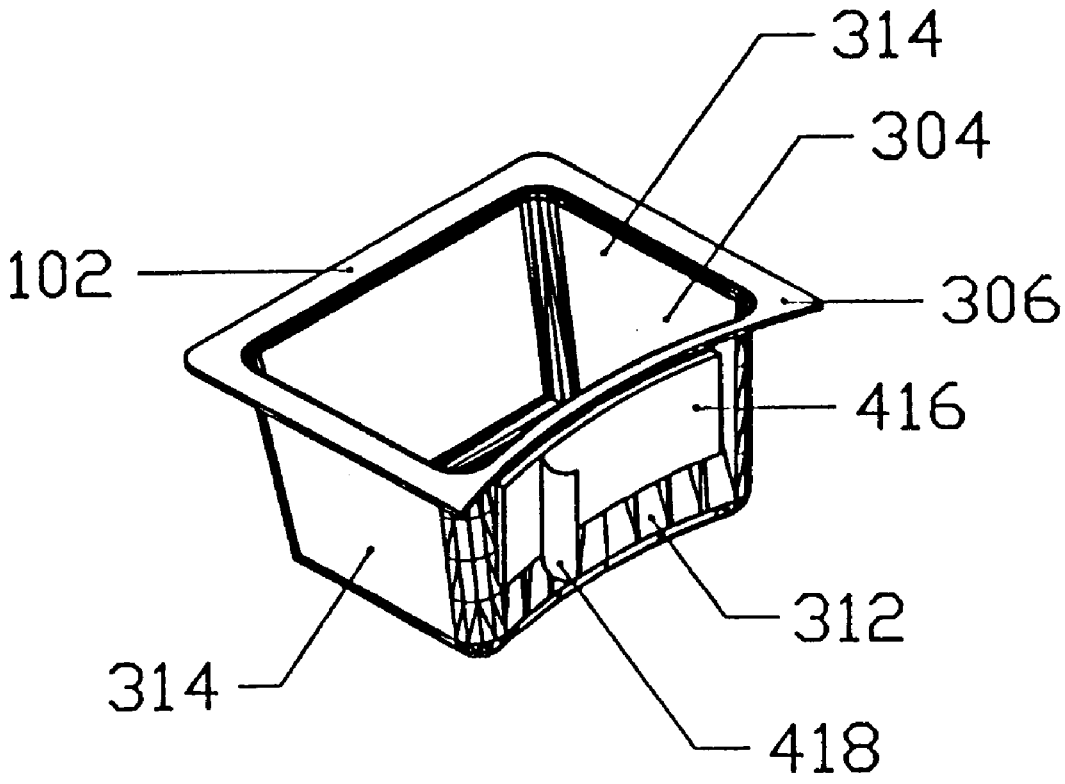
FIG. 9 is a perspective view of a third embodiment of the invention.

FIG. 8 illustrates an alternate embodiment of the invention wherein a food container 104 is fitted with a coupling structure adapted for attaching the food container to a condiment reservoir. In this particular illustration, the coupling structure is shown as being an adhesive strip 412 on the face of the front wall of the food container 104. The adhesive strip is formed as an elongate element having a generally rectangular configuration. The strip 412 is positioned to extend laterally across the face of the front wall of the container. A protective strip, e.g. a mylar strip 410 is positioned over the adhesive strip in order to preclude the adhesive adhering to anything prior to the time that the user wishes to attach a condiment reservoir 102. The adhesive strip 412 may be a strip of double sided tape, wherein one adhesive side of the tape is used to secure the tape to the front wall of the container 104 while the second adhesive face is covered by the protective strip 410 to be used at a later time to secure the condiment reservoir to the container 104. In this particular embodiment the invention may be seen as including only the food container 104 and the coupling structure 410. Structures for coupling the sauce reservoir 102 to the container 104 may include a strip of adhesive material which may be attached to either the food container 104 or the sauce reservoir 102. In some constructions, adhesive material may be attached to both the food container 104 and the sauce reservoir 102. In this construction the sauce reservoir is coupled to the food container 104 by pressing the sauce reservoir against the food container with sufficient force that an adhesive bond is formed between the food container and the sauce reservoir. In this embodiment, the strip of adhesive may be covered by a protective strip which is removed prior to forming the adhesive connection of the two containers. The protective strip would permit the containers to be stored, e.g., in a stacked arrangement, without an adhesive bond being formed between adjacently positioned containers.

Alternate connection structure may include any mechanical fastener which would permit the temporary or permanent connection of the sauce reservoir with the food container even including the integral formation of the sauce reservoir in the structure of the food container.

Referring to drawing FIG. 7, a vacuum-formed sauce reservoir 102 is shown. The container 102 includes a curved rear wall 312 and opposing side walls 314. Fries container 104, has a curved rear structure 114 and a curved frontal structure 116, both structures being convex to the enlarged opening 106. Note, the arc or straightness of curved rear wall 312 shall be dictated by the curve or straightness of the food container frontal structure 116. Again, numerous systems for attaching the sauce reservoir 102 to the fries/food container 104 may be applied, for the purpose of this embodiment the preferred means of attachment requires apertures 122, the apertures 122 provide predetermined positions to attach the reservoir 102. The sauce reservoir has a curved rear wall 312, the curved rear wall 312 approximately matching curved frontal structure 116 of fries container 104. The curved rear wall 312 is designed such that gentle pressure applied to opposing side walls 314 subtly buckles the curved wall 312 and permits clips 310 to pass through apertures 122. By releasing pressure to opposing side walls 314, the sauce reservoir is releasably coupled to the fries container 104.

Figure 10:
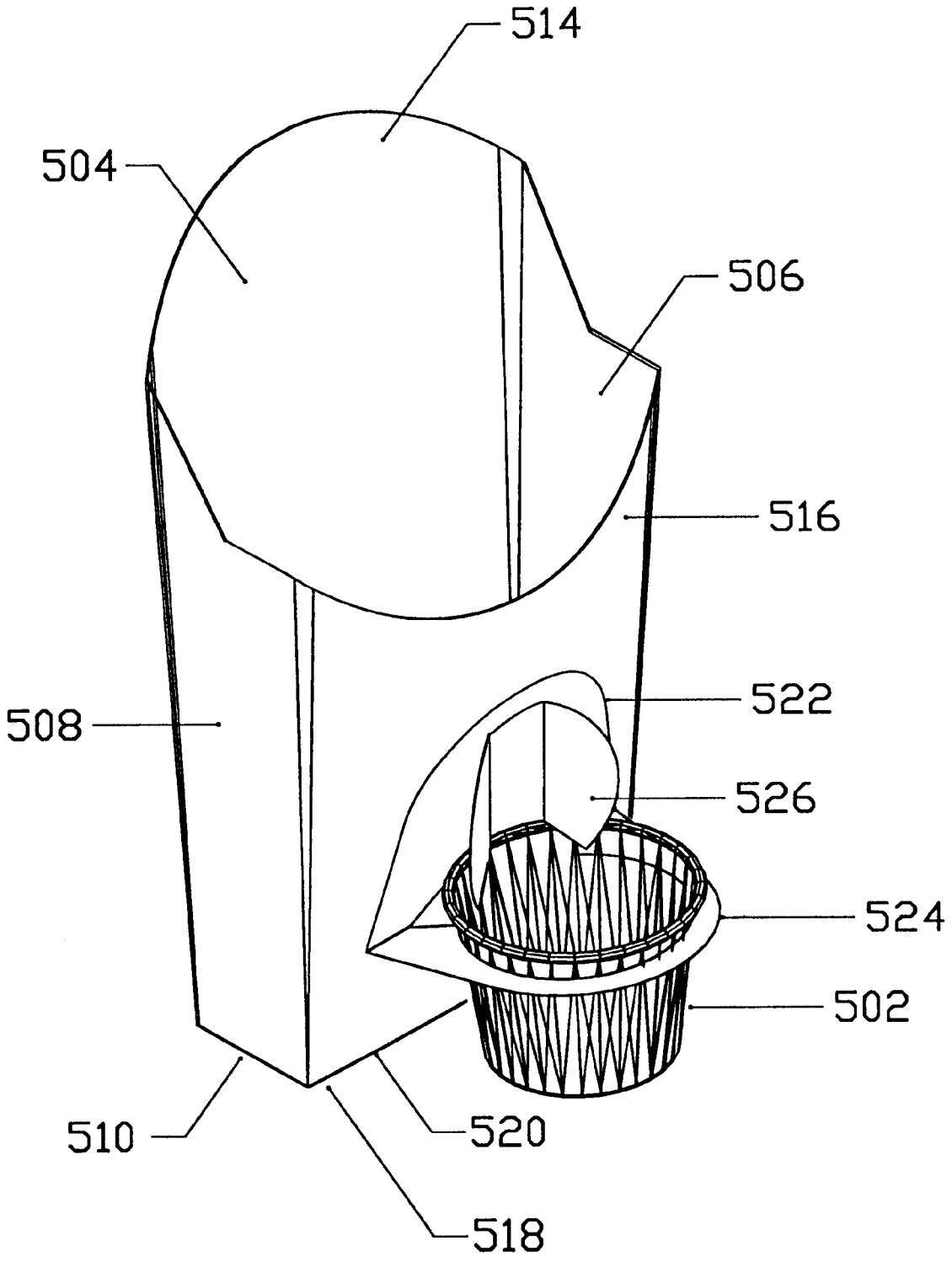
FIG. 10 is a perspective view of a fries container adapted for use in the present invention.

Referring to drawing FIG. 10 a perspective view of the invention is shown as having a catsup reservoir 502 coupled to a fries/food container 504 by means of a die-cut structure 522 forming a carriage 524 cut from fries/food container 504. The die-cut structure 522 configured so as to form a locking device 526 that securely attaches the catsup reservoir 502 into the carriage 524. The fries/food container 504 includes an enlarged opening 506 for receiving french fries (not shown). A side structure 508, having a flat lowermost portion 510, forms a stable base to permit the container to be freestanding when placed onto a horizontal surface. The container further includes a curved rear structure 514 and a curved frontal structure 516. Both the front and rear structures are oriented to be convex to the enlarged opening 506. A bottom structure 518 having a curved shape 520 forms the curves of curved rear structure and the curved frontal structure 516 when the bottom structure 518 is pressed up inside the container from outside to inside. Typically the fries containers are stored flat until needed, at which time the bottom structure 518 is pressed (snapped) up into the underside of the fries/food container 504 creating the enlarged opening 506 thereby forming the shape of the curved rear structure 514 and the curved frontal structure 516. The die-cut structure 522 does not interfere with the manner in which the fries/food containers 504 are stored, even if flat. The die-cut structure 522 is positioned such that when the catsup reservoir 502 is secured into the carriage 224 by means of the locking device 526 the lowermost portion of the catsup reservoir 502 is in the same plane as the flat lowermost portion 510. This enables the fries/food container 504 with the catsup reservoir 502 attached thereto to be freestanding when placed on a horizontal surface.

Figure 11:
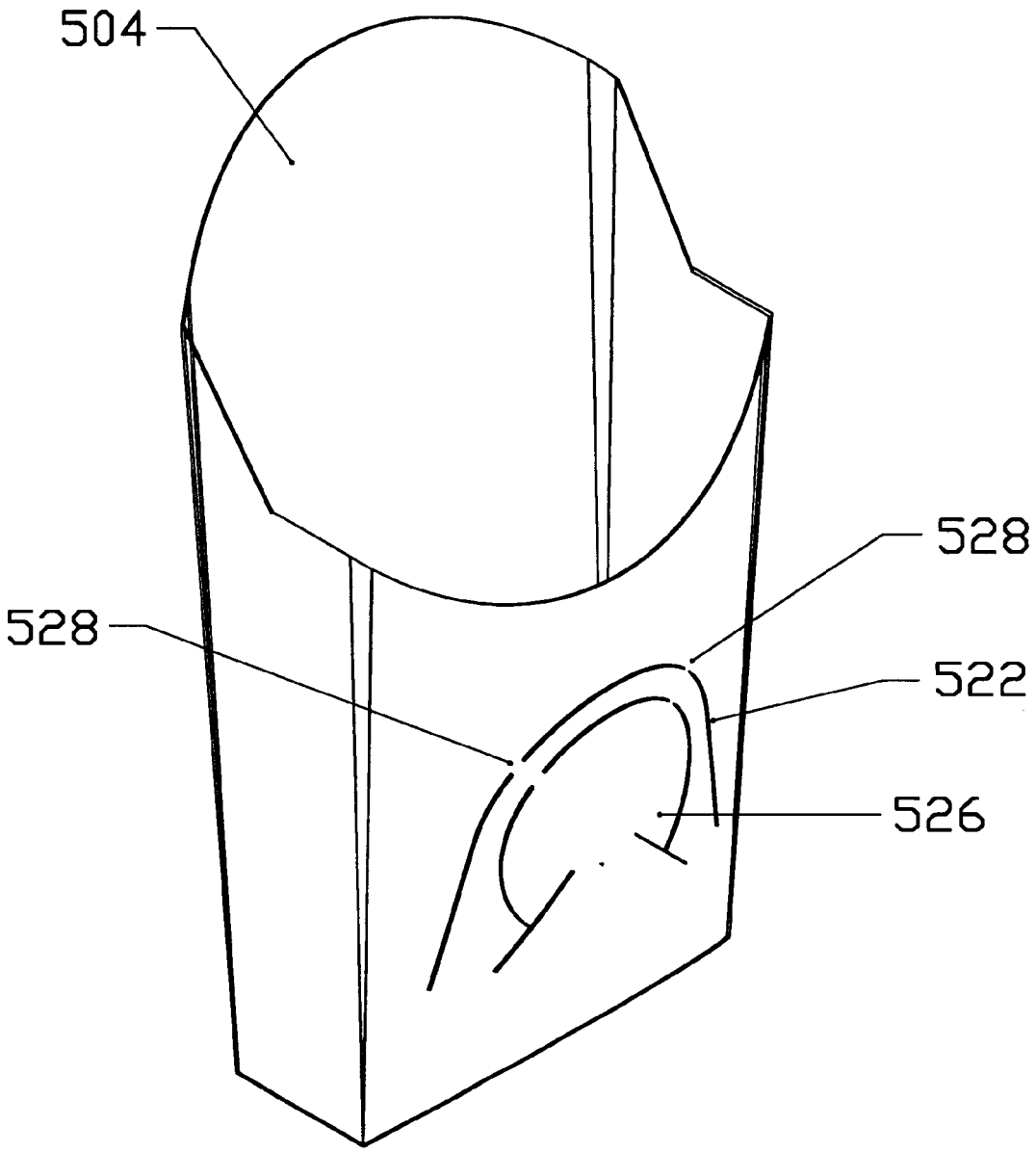
FIG. 11 is a perspective view of a fries container adapted for use in the present invention.

Referring to drawing FIG. 11 a perspective view of the invention shows a fries/food container 504 having a die-cut structure 522 cut into fries/food container 504. The die-cut structure 522 has not yet been folded into position for holding a catsup reservoir as indicated in FIG. 10. The die-cut structure 522 is configured to maintain tearout portions 528 to hold the die-cut closed until purposely folded into position. The diecut structure 522 does not interfere with the conventional manner in which the fries/food containers 504 are stored (even if flat)and does not interfere with the conventional manner in which the fries/food containers 204 are utilized. The die-cut structure 522 is configured such that the fries/food container 504 can be used as a conventional fries container as delineated in FIG. 1 (Prior Art) when catsup is not desired.

Characteristics of the described and illustrated embodiments are intended for illustrative purposes and are not to be considered limiting or restrictive. It is to be understood that various adaptations and modifications may be made by those skilled in the art to the embodiments illustrated herein, without departing form the spirit and scope of the invention, as defined by the following claims thereof.

What is claimed is:

1. A food container arrangement comprising:

a food container defining at least one aperture therein;

a condiment reservoir disposed adjacent said food container; and coupling structures mechanically associated with said food container and said condiment reservoir detachably coupling said container to said condiment reservoir, said coupling structure including at least one clip member mechanically associated with said condiment reservoir and said at least one aperture being dimensioned to receive and form a union with said clip member.

2. The arrangement of claim 1, wherein said at least one aperture is defined in a sidewall of said food container.

3. The arrangement of claim 1, wherein said food container defines an open top and said coupling structure is configured to position an open top of said condiment reservoir adjacent said open top of said food container.

4. A food container arrangement comprising:

a food container;

a condiment reservoir disposed adjacent said food container; and coupling structures mechanically associated with said food container and said condiment reservoir detachably coupling said container to said condiment reservoir, wherein said condiment reservoir and said food container each define a planar bottom surface and wherein said bottom surfaces are oriented co-planar to one another.

5. A food container arrangement comprising:

a food container defining at least one aperture therein a condiment reservoir disposed adjacent said food container; and coupling structures mechanically associated with said food container and said condiment reservoir adapted to couple said container to said condiment reservoir, said coupling structure including at least one clip member mechanically associated with said condiment reservoir and said at least one aperture being dimensioned to receive and form a union with said clip member.

6. The arrangement of claim 5, wherein said at least one aperture is defined in a sidewall of said food container.

* * * * *